US005255912A

United States Patent [19]

Tseng

[11] Patent Number: 5,255,912

[45] Date of Patent: Oct. 26, 1993

[54] ARRANGEMENT OF STRINGING HOLES IN THE YOKE OF A RACKET

[76] Inventor: Kuni Tseng, 6F-1, No. 342, Keelung Road, Sec. 1., Taipei, Taiwan

[21] Appl. No.: 850,507

[22] Filed: Mar. 13, 1992

[51] Int. Cl.[5] ..... A63B 49/20

[52] U.S. Cl. ..... 273/73 G; 273/73 D; 273/73 R

[58] Field of Search ..... 273/73 R, 73 C, 73 D, 273/73 G

[56] References Cited

U.S. PATENT DOCUMENTS 4,988,101 1/1991 Soong ..... 273/73 G X

FOREIGN PATENT DOCUMENTS 2920680 12/1980 Fed. Rep. of Germany ... 273/73 G
2194158 3/1988 United Kingdom ..... 273/73 R
2226250 6/1990 United Kingdom ..... 273/73 G

*Primary Examiner*—V. Millin
*Assistant Examiner*—Raleigh W. Chiu
*Attorney, Agent, or Firm*—Pro-Techtor International

[57] ABSTRACT

An arrangement of stringing holes in the yoke of a racket, comprising at least two rows of the stringing holes in the yoke in substantially parallel to each other and in alternative sequence so as to make the strings passing over different rows of stringing holes in sequential order.

3 Claims, 5 Drawing Sheets

ARRANGEMENT OF STRINGING HOLES IN THE YOKE OF A RACKET

BACKGROUND OF THE INVENTION

This invention relates to an arrangement of stringing holes in the yoke of a racket.

Conventionally, the strike surface defined by the frame and the yoke of a racket is constituted by interweaving the strings in both longitudinal and horizontal directions. The horizontal strings are at both ends passed through opposite sides of the racket, while the longitudinal strings are at upper end, on the one hand, passed through the top of the racket and at lower end, on the other hand, a portion passed through the shoulder and remaining portion through the yoke. As shown in FIG. 5, the longitudinal strings are extended in parallel to each other. Among sixteen longitudinal strings only about six central strings are passed through the yoke while other ten strings are passed through the shoulder portion of the racket. Hence, in the yoke there are only six string holes arranged in a linear row for the strings passing thereover in sequence, as best shown in FIG. 6.

In this kind of conventional racket, the longitudinal strings at both lateral sides that are not passed through the yoke have shorter length and thus cause inferior rebound. In order to provide all longitudinal strings having more uniform lengths, a new kind of racket as referred to FIG. 1 has been recently developed, in which besides the central longitudinal strings, the lateral strings are convergently inclined with respect to the central axis, so that there are fourteen longitudinal strings in total passing through the yoke. But with the normal linear arrangement of string holes as in the yoke of a conventional racket, as shown in FIG. 7, even ten holes impairs the strength of the yoke to the point that the racket may be easily broken, and of course, the yoke cannot accommodate fourteen strings.

A modification as shown in FIG. 8 is suggested, in which the stringing holes are arranged in two rows at opposite surfaces in a form of grooves. Although this arrangement does accommodate fourteen strings, it still weakens the yoke too much to be an effective method of stringing.

SUMMARY OF THE INVENTION

The subject of this invention is to provide a novel arrangement of stringing holes in the yoke of a racket, comprising at least two rows of stringing holes in the yoke substantially parallel to each other and in alternating sequence to accommodate the strings.

According to the present invention a part of the rows of stringing holes can be provided on either or both surfaces of the yoke. A groove may extend along the surface from the holes wherein the string may be recessed so that it is not pulled against a corner of the yoke.

The aforementioned and other objects, features and advantages will be better understood by reference to the following detailed description in connection with the accompanying drawings in which like reference symbols designate like parts throughout the figures.

DETAILED DESCRIPTION OF PREFERRED EMBODIMENTS

Figure 1:
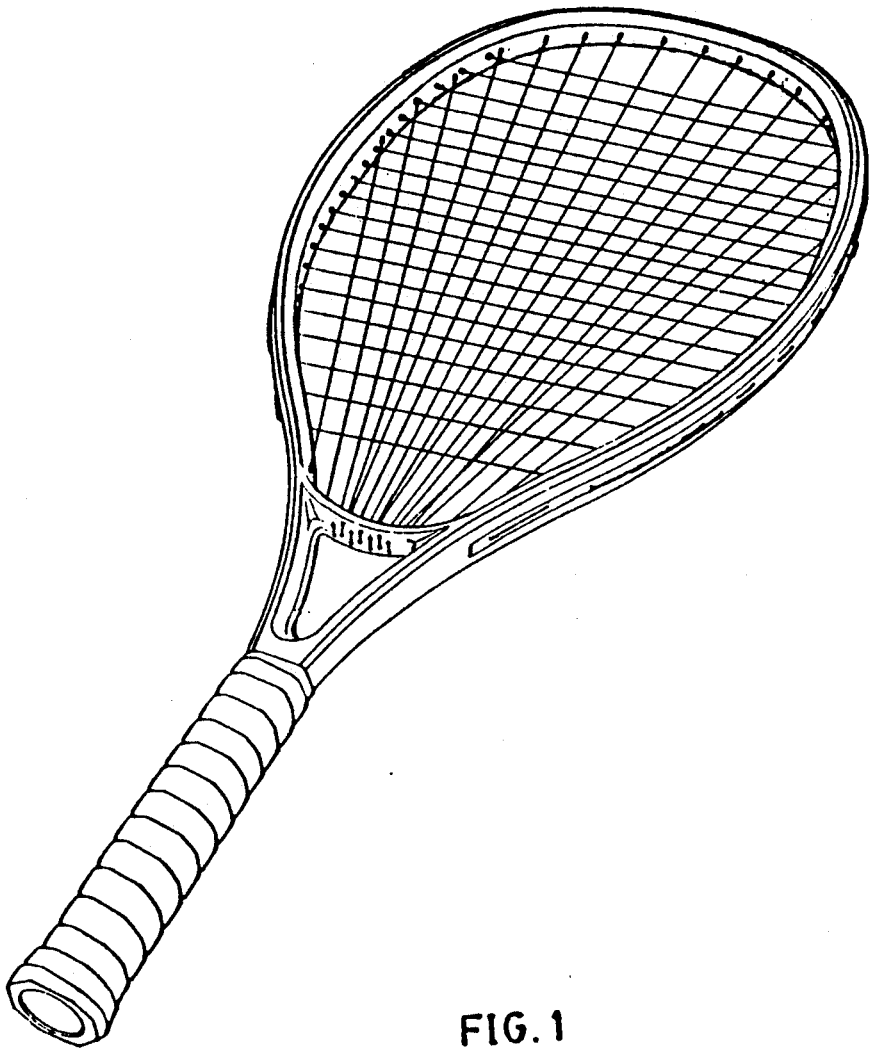
FIG. 1 is a perspective view of the arrangement of stringing holes in the yoke of a racket, according to the invention.
Figure 2:
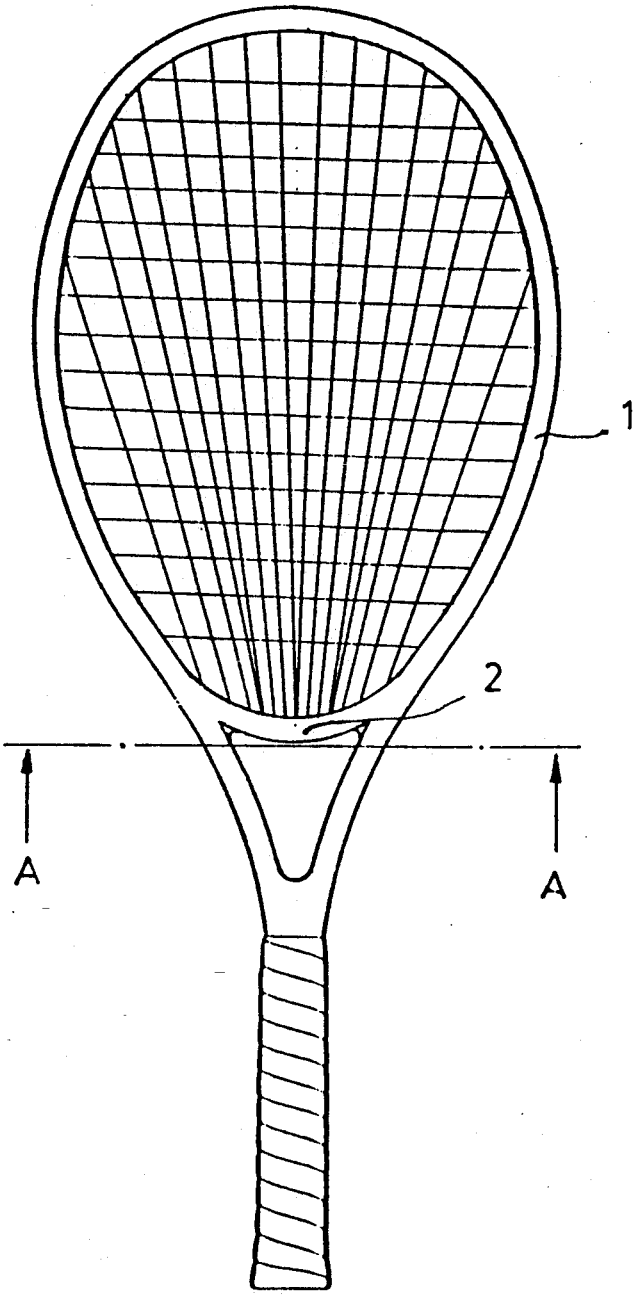
FIG. 2 is a plane view of FIG. 1.

Now, referring to FIGS. 1 and 2 of the drawings, the novel arrangement of stringing holes in the yoke of a racket, according to the present invention, is particularly suited for a racket in which the longitudinal strings are convergently inclined with respect to the central axis on the strike surface. Among sixteen longitudinal strings, only the outmost ones at both lateral sides are passed through the frame 1 at the shoulder portion closed to the yoke 2 whole remaining fourteen strings are all passed through the yoke 2, as illustrated.

Figure 3:
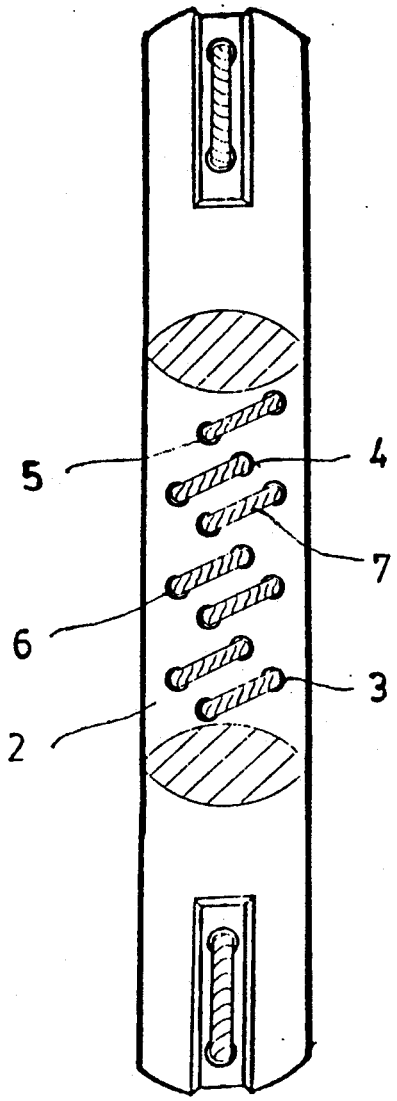
FIG. 3 is an enlarged side view depicting one embodiment of the present arrangement of stringing holes in the yoke of a racket, along the direction indicated by the arrows A—A of FIG. 2.

In order to set fourteen stringing holes at the yoke, the arrangement according to the present invention is composed of four rows, as shown in FIG. 3, in which the first row 3 from the right hand side consists of four holes, the second row 4 consists of three holes, the third row 5 consists of four holes and the fourth row 6 consists of three holes. These rows 3, 4, 5 and 6 of stringing holes are substantially parallel to one another.

Particularly, the stringing holes in the first row 3 and the second row 4 are arranged in alternative sequence. In similar manner, the stringing holes in the third row 5 and the fourth row 6 are arranged in alternative sequence. In effect, the stringing holes in said second row 4 and said third row 5 are also arranged in alternative manner. In stringing operation, the string 7 is passed either from respective hole in the first row 3 to corresponding hole in the third row 5 and vice versa, or from respective hole in the second row 4 to corresponding hole in the fourth row 6 and vice versa, in sequential order. Of course, other stringing procedures might be available without affecting the present arrangement of stringing holes in the yoke 2.

With this multiple rows and alternative arrangement of stringing holes in the yoke 2 according to this embodiment of the present invention, it is possible to provide maximum number of the holes within the limited space in the yoke 2 and to maintain greater distance between adjacent holes, so that the strength of the yoke 2 would not be impaired.

Figure 4:
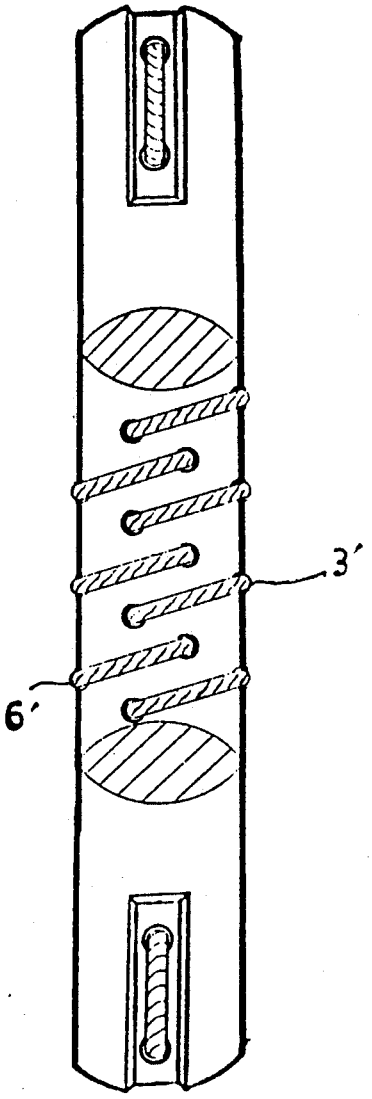
FIG. 4 is similar to FIG. 3, but depicts another embodiment.
Figure 5:
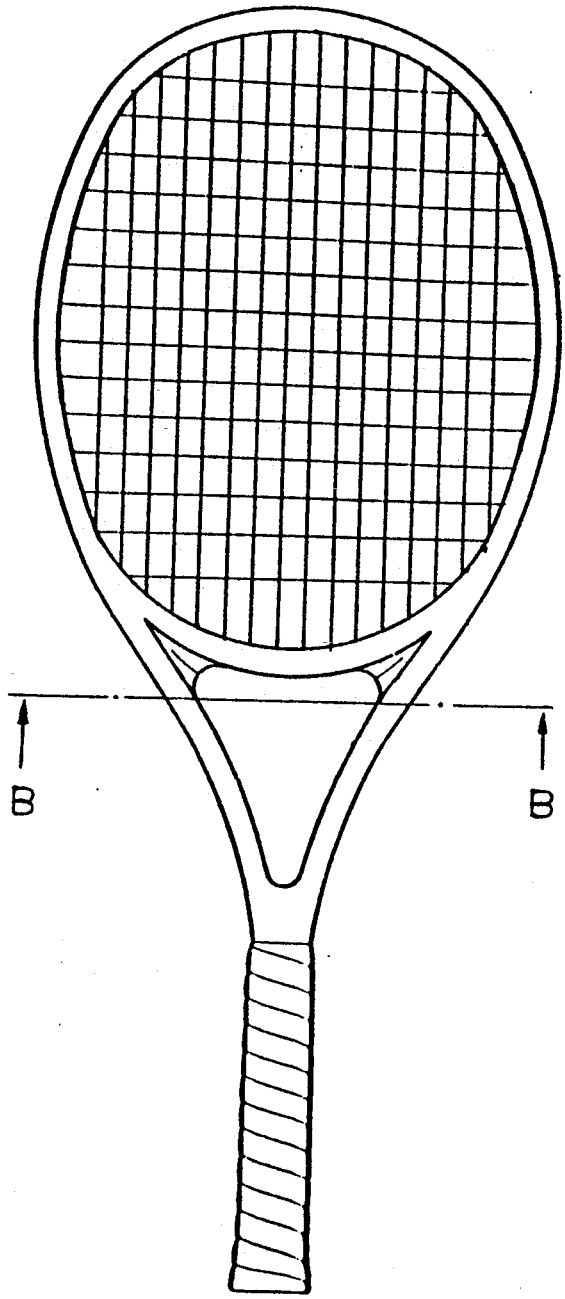
FIG. 5 PRIOR ART
FIG. 5 is a plane view of conventional racket.
Figure 6:
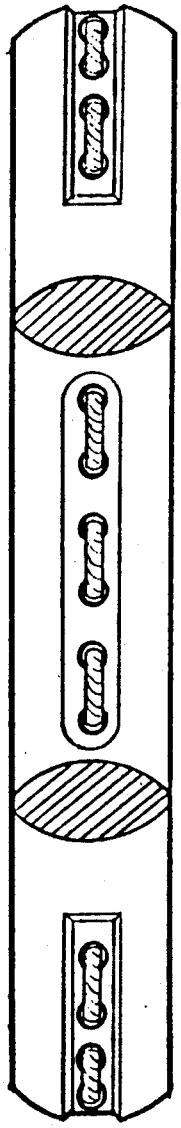
FIG. 6 PRIOR ART
FIG. 6 is an enlarged side view along the direction indicated by the arrows B—B of FIG. 5.
Figure 7:
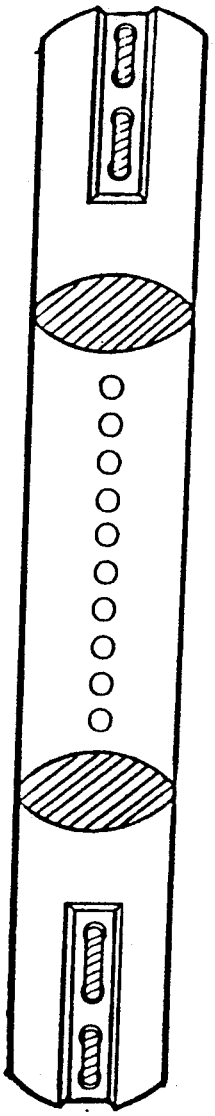
FIG. 7 PRIOR ART
FIG. 7 is similar to FIG. 6, but depicts the intensive phenomenom by increasing the number of stringing holes.
Figure 8:
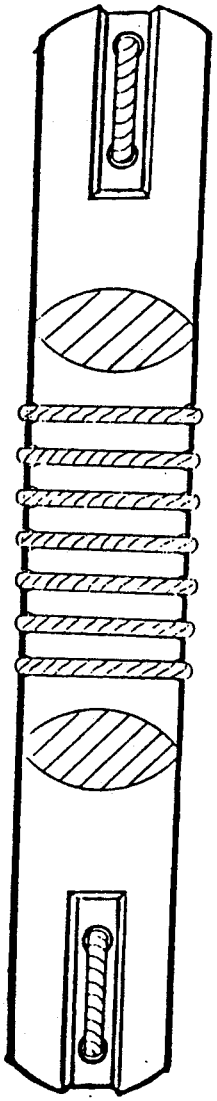
FIG. 8 PRIOR ART
FIG. 8 is an another embodiment in the prior art.

Another embodiment according to the present invention is illustrated in FIG. 4, which is substantially similar to FIG. 3. In this embodiment, the holes of the first row 3' and of the fourth row 6' are instead formed on opposite surfaces of the yoke 2 with a groove extending from the hole to the adjacent surface of the yoke. The stringing operation is similar to that as described with reference to FIG. 3, yet the distance between adjacent holes becomes even greater.

While there have been shown and described what are at present considered the preferred embodiments of the present invention, it will be obvious to those skilled in the art that various changes and modifications may be made therein without departing from the scope of the invention as defined by the appended claims.

What I claim is:

1. An arrangement of holes in a yoke of a racket through which strings of the racket are passed of four substantially parallel rows of holes in the yoke, wherein the rows are offset so that the string does not pass through the yoke in a plane parallel to or normal to the striking surface; wherein the first row consists of four holes, the second row consists of three holes, the third row consists of four holes, and the fourth row consists of three holes.

2. The arrangement of holes as claimed in claim 1 wherein:

during a stringing operation, the strings are passed from holes in the first row to holes in the third row or vice versa, and then from the second row to the fourth row or vice versa in sequence.

3. The arrangement of holes as claimed in claim 1 wherein:

the first and the fourth row of holes are on opposing surfaces of the yoke, the opposing surfaces being those parallel to the plane of the striking surface, wherein the first and fourth row of holes have grooves extending therefrom and connecting the first and fourth rows of holes with the third and second rows respectively, so that during the stringing operation the string is not pulled across an edge of the yoke.

* * * * *